US009771775B2

(12) United States Patent
Klompsma et al.

(10) Patent No.: US 9,771,775 B2
(45) Date of Patent: Sep. 26, 2017

(54) VALVE FOR A HYDROCARBON WELL, HYDROCARBON WELL PROVIDED WITH SUCH VALVE AND USE OF SUCH VALVE

(71) Applicant: SHELL OIL COMPANY, Houston, TX (US)

(72) Inventors: Derk Lucas Klompsma, Sappemeer (NL); Lubbertus Lugtmeier, Assen (NL)

(73) Assignee: SHELL OIL COMPANY, Houston, TX (US)

( * ) Notice: Subject to any disclaimer, the term of this patent is extended or adjusted under 35 U.S.C. 154(b) by 465 days.

(21) Appl. No.: 14/356,452

(22) PCT Filed: Nov. 6, 2012

(86) PCT No.: PCT/EP2012/071877
§ 371 (c)(1),
(2) Date: May 6, 2014

(87) PCT Pub. No.: WO2013/068323
PCT Pub. Date: May 16, 2013

(65) Prior Publication Data

US 2015/0240594 A1 Aug. 27, 2015

(30) Foreign Application Priority Data

Nov. 8, 2011 (EP) ..... 11188299

(51) Int. Cl.
*E21B 34/02* (2006.01)
*E21B 34/10* (2006.01)
*E21B 34/00* (2006.01)

(52) U.S. Cl.
CPC ..... *E21B 34/10* (2013.01); *E21B 34/02* (2013.01); *E21B 2034/007* (2013.01); *Y10T 137/8671* (2015.04)

(58) Field of Classification Search
CPC combination set(s) only.
See application file for complete search history.

(56) References Cited

U.S. PATENT DOCUMENTS 2,144,144 A 1/1939 Crickmer
2,244,684 A 6/1941 Foran
(Continued)

FOREIGN PATENT DOCUMENTS

CA 2545828 11/2007
CN 1491314 4/2004
(Continued)

OTHER PUBLICATIONS

Ali, A.J. et al.; "Investigation of New Tool to Unload Liquids From Stripper-Gas Wells"; SPE Paper 85136; SPE Annual Technical Conference and Exhibition held in Denver Colorado; Oct. 5-8, 2003.

(Continued)

*Primary Examiner* — David Andrews
*Assistant Examiner* — Ronald Runyan

(57) ABSTRACT

A safety valve for a hydrocarbon wellbore includes a valve housing; a tubular valve member having an axially extending tube wall; and an operating mechanism for operating the valve member. The housing has a passage extending from a lower opening to an upper opening. The tube wall has one or more radial inlet apertures therethrough. The lower end part of the tube wall is closed. The valve member is axially movable in the passage between a flow position and a blocking position. In blocking position, the valve member is retracted in the housing such that the inlet apertures lie inside the housing and fluid flow between the lower opening and upper opening is prevented by the closed lower end part of the valve member. In the flow position, the valve member (Continued)

projects below the housing such that the one or more radial inlet apertures lie outside the housing.

33 Claims, 3 Drawing Sheets

(56) References Cited

U.S. PATENT DOCUMENTS

| | | | | |
|---|---|---|---|---|
| 2,660,248 | A * | 11/1953 | Brown | E21B 33/0415 166/78.1 |
| 2,662,554 | A | 12/1953 | Singer | |
| 2,951,445 | A * | 9/1960 | Corley, Jr. | F04B 47/04 166/54.1 |
| 3,097,695 | A * | 7/1963 | Le Rouax | E21B 33/047 166/97.5 |
| 3,130,789 | A | 4/1964 | Alexander et al. | |
| 3,292,706 | A | 12/1966 | Grimmer | |
| 3,411,584 | A | 11/1968 | Sizer et al. | |
| 3,417,827 | A | 12/1968 | Smith et al. | |
| 3,494,421 | A | 2/1970 | Dollison | |
| 3,739,846 | A | 6/1973 | Beson | |
| 3,845,784 | A | 11/1974 | Sullivan | |
| 3,878,312 | A | 4/1975 | Bergh et al. | |
| 4,042,033 | A | 8/1977 | Holland et al. | |
| 4,072,166 | A | 2/1978 | Tiraspolsky et al. | |
| 4,260,020 | A | 4/1981 | Nelson et al. | |
| 4,311,584 | A | 1/1982 | Smith et al. | |
| 4,399,871 | A | 8/1983 | Adkins et al. | |
| 4,487,221 | A | 12/1984 | Zwart | |
| 4,629,002 | A * | 12/1986 | Pringle | E21B 34/101 166/324 |
| 4,784,225 | A | 11/1988 | Petersen | |
| 5,027,903 | A | 7/1991 | Gipson | |
| 5,048,611 | A | 9/1991 | Cochran | |
| 5,125,457 | A | 6/1992 | Meaders | |
| 5,209,946 | A | 5/1993 | Lowther et al. | |
| 5,915,475 | A | 6/1999 | Wells et al. | |
| 6,354,465 | B2 | 3/2002 | Bell et al. | |
| 6,382,321 | B1 | 5/2002 | Bates et al. | |
| 6,427,773 | B1 | 8/2002 | Albers | |
| 6,494,265 | B2 | 12/2002 | Wilson et al. | |
| 7,559,296 | B2 | 7/2009 | Perotto | |
| 8,631,875 | B2 | 1/2014 | Nguyen et al. | |
| 2002/0074129 | A1 | 6/2002 | Moore | |
| 2002/0157837 | A1 | 10/2002 | Bode et al. | |
| 2003/0056958 | A1 | 3/2003 | Allan | |
| 2003/0106588 | A1 | 6/2003 | Zahe | |
| 2004/0035584 | A1 | 2/2004 | Gleim et al. | |
| 2004/0118567 | A1 | 6/2004 | Skeels | |
| 2005/0061221 | A1 | 3/2005 | Paszkowski | |
| 2005/0173125 | A1 | 8/2005 | Naquin | |
| 2005/0233086 | A1 | 10/2005 | Chan et al. | |
| 2005/0252997 | A1 | 11/2005 | Gluck et al. | |
| 2006/0113082 | A1 | 6/2006 | Moffett et al. | |
| 2006/0235175 | A1 | 10/2006 | Baradie et al. | |
| 2007/0108380 | A1 | 5/2007 | Poe et al. | |
| 2008/0271893 | A1 | 11/2008 | Hill | |
| 2008/0286556 | A1 | 11/2008 | D Urso et al. | |
| 2009/0065215 | A1 * | 3/2009 | Tveiten | E21B 43/123 166/368 |
| 2009/0200013 | A1 | 8/2009 | Craster et al. | |
| 2009/0255684 | A1 | 10/2009 | Bolding | |
| 2010/0051289 | A1 | 3/2010 | Constantine | |
| 2010/0096127 | A1 | 4/2010 | Jordy | |
| 2010/0126725 | A1 | 5/2010 | Ravensbergen | |
| 2011/0048724 | A1 | 3/2011 | Pringle et al. | |
| 2013/0133896 | A1 | 5/2013 | Tveiten et al. | |
| 2013/0153239 | A1 | 6/2013 | McIntosh et al. | |
| 2014/0182857 | A1 | 7/2014 | Klompsma et al. | |

FOREIGN PATENT DOCUMENTS

| | | |
|---|---|---|
| CN | 1761799 | 4/2006 |
| CN | 101273182 | 9/2008 |
| EP | 0608081 | 7/1994 |
| EP | 0638372 | 2/1995 |
| EP | 638372 | 2/1995 |
| EP | 2128378 | 12/2009 |
| GB | 2192921 | 1/1988 |
| GB | 2172321 | 4/2010 |
| GB | 2479432 | 10/2011 |
| WO | 8602412 | 4/1986 |
| WO | 2005045183 | 5/2005 |
| WO | 2006069247 | 6/2006 |
| WO | 2006133351 | 12/2006 |
| WO | 2008002473 | 1/2008 |
| WO | 2010096349 | 8/2010 |
| WO | 2013004609 | 1/2013 |

OTHER PUBLICATIONS

Bolt, David: Advancements in Hydraulic Dewatering Technology, 7th European Gas Well Deliquification Conference Hydraulic Dewatering Introduction and History, Sep. 24, 2012 (Sep. 24, 2012), XP55144810, Groningen Retrieved from the Internet: URL:http://alrdc.com/workshops/2013_2013EuropeanGasWel1/Private/19_EGWDC2013_New hydraulic piston pumps_Cormorant.pdf [retrieved on Oct. 7, 2014].

Furrow, B., et al.: Gas Well Deliquification, Workshop Selection & Validation of Hydraulic Dewatering Pumps in the Natural Gas Dewatering Pumps in the Natural Gas Industry: An Update Brendan Furrow, Business Development Manager, Apr. 25, 2012 (Apr. 25, 2012), XP55144841, Retrieved from the Internet: URL:http://www.cormorant.us.eom/PDF/2012.Gas.Well.Conference.pdf [retrieved on Oct. 7, 2014].

Putra, S.A., et al; "Design of Tubing Collar Inserts for Producing Gas Wells Below Their Critical Velocity"; SPE Paper 71554; 2001 SPE Annual Technical Conference and Exhibition held in New Orleans, Louisiana; Sep. 30-Oct. 3, 2001.

Takamasa, T., et al; "Experimental Study of Gas-Liquid Two Phase-Flow Affected by Wall Surface Wettability"; International Journal of Heat and Fluid Flow 29; pp. 1593-1602; Journal Homepage: www.elsevier.com/locate/ijff; 2008.

PCT International Search Report, Application No. PCT/EP2012/071877 dated Dec. 3, 2012.

PCT International Search Report, Application No. PCT/EP2012/062676 dated Aug. 29, 2012.

PCT International Search Report, Application No. PCT/EP2012/052756 dated Apr. 12, 2013.

* cited by examiner

VALVE FOR A HYDROCARBON WELL, HYDROCARBON WELL PROVIDED WITH SUCH VALVE AND USE OF SUCH VALVE

PRIORITY CLAIM

The present application is a National Stage (§371) application of PCT/EP2012/071877, filed Nov. 6, 2012, which claims priority from European Application 11188299.9, filed Nov. 8, 2011, each of which are hereby incorporated by reference in their entirety.

The invention is in the field of hydrocarbon production (further called the field). More specific, the invention relates to a valve, such as a safety valve, for a hydrocarbon well, a tree, a well and retro-fit assembly comprising such a valve and a method of retro-fitting a valve, such as a production flow safety valve.

In hydrocarbon wells it is common to use one or more safety valves to provide closure of the production tubing in the event of emergency or for other reasons like maintenance or repair. Such a safety valve can be provided above or below the well head.

In case it is provided above the well head, the safety valve is in practise often installed inside the so called tree (in the field also called Christmas tree—abbreviated as XMT). As in general the tree is arranged above ground level—which level is in case of off-shore the sea bottom and in case of on shore the surface of the land—this safety valve is in the field frequently indicated as surface safety valve (abbreviated as SSV). A surface safety valve is in general a ball valve—having a rotatable ball with a bore—which is manually, hydraulically or pneumatically operated. In this document a surface safety valve is, from time to time, also called an above surface safety valve. The term 'above' is in this respect not intended to have the literal meaning, but is just intended to differentiate over the well known term 'sub surface safety valve'.

Safety valves arranged below the well head are usually arranged at a depth of 100-150 meters below ground level—which level is, as said before, in case of off-shore the sea bottom and in case of on shore the surface of the land—. These safety valves are in the field frequently indicated as sub surface safety valves (abbreviated as SSSV). Known sub surface safety valves are provided as an elongate tubular component which is inserted in the production tubing as tubing retrievable or wire retrievable. In case of tubing retrievable, the component is provided at its upper end and lower end with connection means, like screw thread, for attachment to an upper and lower part, respectively, of the production tubing so that the lower production tubing part, tubular component and upper production tubing part form a continuous string. In order to retrieve a tubing retrievable component, the whole tubing has to be withdrawn from the well bore up to the component surfaces. In case of wire retrievable, the tubular component is inserted as a plug into the production tubing, and fixed to the inner wall of the production tubing, for example by a landing nipple provided inside the production tubing and a lock mandrel having keys provided on the outside of the tubular component. For retrieving a wire retrievable component, a wire provided with a so called jar is to be lowered into the production tubing, the wire/jar is to be coupled to the component, the component is to be disengaged from the production tubing and subsequently retrieved by withdrawing the wire together with connected component from the production tubing.

The valve mechanism of known sub surface safety valves comprises a control sleeve. This control sleeve is open at both longitudinal ends and pre biased in upward direction by a fail safe spring. The control sleeve can be pushed downwards by hydraulic pressure acting on a rib or flange attached around the control sleeve. When in its upward position the lower end of the sleeve is closed by a flapper. The flapper is in fact a plate which can pivot around a horizontal pivot axis between a horizontal position, in which the lower end of the control sleeve is closed, and a vertical position, in which the flapper rests against the outside of the wall of the sleeve. By pushing the control sleeve downwards with hydraulic pressure, the flapper is pivoted from its horizontal position to its vertical position allowing production flow to pass through the control sleeve.

In hydrocarbon production, reliable functioning of safety valves, such as SSV's and SSSV's, is of the utmost importance. From the perspective of safety regulations it is of utmost importance that the safety valves are highly reliable in their closing action as in case of emergency the safety valve or safety valves of a production well should prevent blow out of gaseous and/or liquid hydrocarbon into the environment. From the perspective of economics it is also very important that a safety valve can be opened again after being closed. In this respect it is to be noted that safety valves are in practise also closed for other reasons than emergency situations. A safety valve might for example be closed for maintenance or repair purposes, or just because the production well is to be shut down temporarily for economic or other reasons. In case an SSV or SSSV cannot be opened again after being closed, this results, in the field of hydrocarbon production, in enormous costs because replacement requires disassembling of the XMT and/or upper part of the well.

In hydrocarbon wells sediments settle onto surface in contact with gaseous and/or liquid hydrocarbon and also surfaces in contact with gaseous and/or liquid hydrocarbon are susceptible to corrosion and other chemical reactions which might cause settling of sediments as well. These phenomena also occur in safety valves. In a valve with a flapper and/or control sleeve for operating the flapper, as is frequently used in a SSSV, sediment settles on the seat of the flapper as well as the flapper itself. This results in leakage in case the flapper is closed as the sealing surfaces of flapper and seat are affected by the sediment and/or chemical reactions. Further, sediments and/or chemical reactions might cause the control sleeve getting stuck in its withdrawn position so that it cannot be pushed down to open the flapper again. In a valve with a ball, as is frequently used in a SSV, sediment and/or chemical reactions might cause the ball getting stuck in its closed or open position or might hinder full closure of the ball valve.

The object of the present invention is providing a solution for at least some of the above problems associated with introducing an additional tubing extending down into the well. More specifically, the object of the invention is providing a valve, such as a safety valve, for a hydrocarbon well, which valve is very reliable—preferably more reliable than safety valves know in the prior art for hydrocarbon wells—in its operation both with respect to its closing action as well as its opening action.

According to a first aspect of the invention, this object is achieved by providing a valve, such as a safety valve, for a hydrocarbon well, said well comprising a production tubing extending from a well head in the direction of a lower end of the well;

wherein the valve comprises:

a valve housing;

a tubular valve member having an axially extending tube wall;

an operating mechanism for operating the tubular valve member;

wherein the valve housing has a lower end and is provided with a passage extending from a lower passage opening to an upper passage opening, the lower passage opening being provided in the lower end of the housing and opening in downward direction;

wherein the tube wall is provided with one or more radial inlet apertures through said tube wall;

wherein a lower end part of the tubular valve member is defined as a part of the tubular valve member extending from the lower end of the tubular valve member to the one or more radial inlet apertures;

wherein said lower end part is closed;

wherein the tubular valve member extends in the passage and is axially movable, by the operating mechanism, with respect to the valve housing between a flow position and a blocking position;

wherein, in the blocking position, the tubular valve member is retracted in the valve housing such that the one or more radial inlet apertures lie inside the valve housing and fluid flow between the lower passage opening and upper passage opening is prevented by the closed lower end part of the tubular valve member; and wherein, in the flow position, the tubular valve member projects from the lower end of the valve housing in an extent such that the one or more radial inlet apertures lie outside the valve housing to allow fluid flow from outside the tubular valve member via the one or more radial inlet apertures through the tubular valve member.

Due to the lower end part of the tubular valve member being closed, this lower end part does not allow fluid, like a gaseous or liquid hydrocarbon, to pass from outside the tubular valve member to inside the tubular valve member (or vice versa). Consequently, when this lower end part is withdrawn inside the passage, it will—valve closed—block the passage and prevent flow through the passage as also the one or more radial inlet apertures lie inside the passage and are closed off by the inner wall of the passage. Flow through the passage is also prevented—valve closed—when this lower end part projects downwardly from the passage, provided the one or more radial inlet apertures lie inside the passage. Flow through the passage—as well as through the tubular valve member in this passage—is allowed when—at least part of—the one or more radial inlet apertures of the tubular valve member lie outside the passage/valve housing. Defining the 'closed length' of the closed lower end part as—viewed in axial direction of the tubular valve member—the length from the lower end of the tubular valve member to the—lower end of the—one or more radial apertures, this means that for the valve according to the invention being in an open position, called flow position, the tubular valve member should extend below the lower end of the valve housing (or below the lower passage opening) over a distance of at least the 'closed length'.

In case the tubular valve member of the valve according to the invention is in closed position, the regular operating mechanism for operating the tubular valve member—like hydraulic pressure acting on a flange attached outside to the tubular valve member as is known from conventional safety valves having a control sleeve and flapper with flapper—might not be capable of moving the tubular valve member axially to its flow position due to the tubular valve member being stuck in the passage or due to other reasons. If this situation occurs, the valve according to the invention allows an additional manner for forcibly opening the valve according to the invention. This is due to the closed lower end part of the tubular valve member. This closed lower end part allows applying a downward hydraulic pressure into the tubular valve by simply pressurizing the tubing connected to the upper passage opening of the valve with a hydraulic liquid like water.

In case the tubular valve member of the valve according to the invention is in flow position, it is conceivable that sediment might settle onto the tubular valve member, but there is no seat—like in case of a flapper valve—which is affected so that after closure leakage remain. According to the invention the closure action is simply by withdrawing the tubular valve member into the passage/valve housing. Sediments which might have settled on the outside of the tube wall will be scraped off by the edge of the lower passage opening when the tubular valve member is withdrawn into the passage for closure.

The valve according to the invention can be arranged and constructed as a tubing retrievable or wire retrievable valve. The valve according to the invention can also be fitted in a hydrocarbon well in other manner than wire or tubing retrievable manner. Further, the valve according to the invention can be used as a surface safety valve (SSV) and/or sub-surface safety valve (SSSV).

Concerning the term 'hydrocarbon well', it is noted that in this application this term comprises not only 'production wells through which a hydrocarbon fluid surfaces' but also 'injection wells for pressurizing sub-surface formations in order to force hydrocarbon fluid to surface' and 'storage wells for sub-surface storage of hydrocarbon fluid'. Further it is noted that the valve according to this invention is especially intended for arrangement in the path of the production flow to be able to interrupt this production flow. A valve arranged in the path of the production flow is also called a production flow safety valve.

According to a further embodiment of the valve according to the invention, the passage is provided with at least one inner seal, which is attached to the inside of the passage, extends circumferentially around the tubular valve member and seals circumferentially against the tubular valve member to prevent fluid from bypassing the tubular valve member between the outside of the tubular valve member and the inside of the passage. One or more such inner seals might contribute in reducing or preventing leakage through the passage, along the outside of the tubular valve member, for example when the tubular valve member is in blocked position.

According to a further embodiment of the valve according to the invention, a first said inner seal lies, viewed in the blocking position of the tubular valve member, above the one or more radial inlet apertures whilst a second said inner seal lies below the one or more radial inlet apertures. These seals prevent at the location of the one or more radial inlet apertures, in blocking position of the tubular valve member, bypass of medium around the tube in both the upward direction (i.e. the direction from the lower passage opening to the upper passage opening) and the downward direction (i.e. the direction from the upper passage opening to the lower passage opening).

According to a further embodiment of the valve according to the invention, the valve housing is provided with a pressure equalizing line debouching on the one hand into the space below the valve housing and on the other hand into the passage at a location, which lies, when the tubular valve member is in its blocking position, below the one or more radial inlet apertures. In case the channel below the valve is under overpressure relative to the inside of the tubular valve member, this considerably reduces the forces required to move the tubular valve member from blocking position to flow position. With this embodiment, optionally a sealing—which seals against the tubular valve member—can be provided on the inside of the passage above as well as below or just around the location where the equalizing line debouches into the passage.

According to a further embodiment of the valve according to the invention, the tube wall is provided with a radial outlet aperture through said tube wall; wherein the valve housing comprises a radial bore; wherein the radial bore has one end debouching into the passage and the other end facing away from the passage for connection to a further flow channel; and wherein a said radial outlet aperture and the radial bore are radially aligned when the tubular valve member is in its flow position. Such a radial bore and radial outlet aperture provide connection to a flow channel which extends radially with respect to the axial direction of the passage. This allows the valve according to the invention to be arranged at a location between two channels which extend transverse to each other. This might especially be practical in case the valve according to the invention is mounted in an XMT. Concerning the term bore, it is to be noted that the cross sectional shape—i.e. the shape transverse to the flow through the bore—might be round, but does not need to be round. The cross sectional shape might be oval, square, rectangular or any other shape.

According to a further embodiment of the valve according to the invention, the radial outlet aperture is, when the valve member is in its blocking position, closed by the inner wall of the passage. This arrangement provides, in the blocking position, a double closure of the valve as the radial inlet apertures of the valve member as well as the radial outlet aperture of the valve member is closed.

According to a further embodiment of the valve according to the invention, a third said inner seal is provided above—and preferably also close to or adjacent—the radial bore and a fourth said inner seal is provided below—and preferably also close to or adjacent—the radial bore. These seals prevent at the location of the radial bore, in blocking position as well as flow position of the tube, bypass of medium around the tube in both the upward direction (i.e. the direction from the lower passage opening to the upper passage opening) and the downward direction (i.e. the direction from the upper passage opening to the lower passage opening).

According to a further embodiment—having a radial bore—of the valve according to the invention, the tubular valve member or passage is closed in an area above the radial outlet aperture and the radial bore.

According to a further embodiment of the valve according to the invention, in which movement of the tubular valve member to the flow position defines an opening direction, and movement of the valve member to the blocking position defines a closing direction, the operating mechanism comprises:

a spring biasing the tubular valve member in the closing direction;

a piston member fixed to the tubular valve member;

a pressure chamber adjacent the side of the piston member facing in the closing direction;

wherein the pressure chamber is provided with an inlet/outlet valve assembly for feeding a hydraulic fluid into the pressure chamber to move the valve member in the opening direction respectively to discharge said hydraulic fluid from the pressure chamber for moving the valve member in the closing direction by action of the spring. This type of operating mechanism, which is in the field of hydrocarbon wells a proven and reliable mechanism for sub surface safety valves (SSV's), is also very useful in a valve according to the present invention and can according to the invention both be used in SSV as SSSV applications.

According to a further embodiment of the valve according to the invention, a flapper valve is provided in a section of the passage, which flapper valve is spring biased into a closed position blocking the passage; and wherein this passage, tubular valve member and flapper valve are arranged for opening the flapper valve upon passing the tubular valve member through the section of this passage and closing the flapper valve upon withdrawing the tubular valve member from the section of this passage. According to the present invention, this flapper valve might serve as a second valve member of a valve assembly according to the invention, in which case the tubular valve member serves as actuating member for operating the flapper valve. In this case a double closure is obtained when the tubular valve member is in its blocked position. This because then also the flapper valve is also blocking the flow through the passage. However, it is also possible to use the tubular valve member as only valve member which is moveable between the flow position and blocking position whilst the flapper valve is permanently kept open by the tubular valve member. In this latter case, the flapper valve might serve as closing mechanism (one could also say as second valve member in the same passage) in case the tubular valve member is removed, for example for maintenance or repair, or not yet installed. This allows for example removing the tubular valve member in order to remove sediments from it.

According to a further embodiment of the valve according to the invention, the valve housing is provided with a circumferential hanger rib for support onto a hanger seat, such as a landing nipple, extending around the valve housing. A hanger rib resting on a hanger seat, like a landing nipple, is in the field of hydrocarbon wells a well known technique for mounting components inside a tubing, like a production tubing. These known techniques as well as yet unknown variants thereof are very well suited for use in combination with the invented valve according to this invention. In relation to this embodiment, the hanger rib might comprise:

a continuous rib extending continuously all around the valve housing; and/or a multiplicity of rib segments, like keys or locking dogs, arranged at intervals circumferentially around the valve housing.

A landing nipple may be arranged on the inside of a tubular wall and comprises in general one, two or more circumferential grooves formed in the inner wall surface of a tubular element. Below these one, two or more circumferential grooves, the inner wall surface provides a sealing area. As is further well known in the field of hydrocarbon wells, such a landing nipple is often used in combination with a component having so called lock mandrel. A lock mandrel comprises in general a fishing neck to allow retrieval of the component and a number of keys arranged externally around the circumference of the component. Usually these keys are spring loaded and can assume three positions:

a retracted position in which the keys are radially retracted within the component; a projecting;

spring loaded position in which the keys project radially outward from the component and are radially movable against the action of a spring; and a locked position in which the keys project radially outward from the component and are kept unmovable with respect to the component by a locking mechanism.

The technique using a landing nipple and a lock mandrel is suitable for mounting a valve assembly according to the invention into a hydrocarbon well.

According to a further embodiment of the valve assembly according to the invention, the insert assembly comprises a lower insert part and an upper insert part; wherein the lower insert part comprises the passage and is adapted for said plugging insertion into the production tubing; and wherein the operating mechanism is provided in the upper insert part and the tube is suspended from the upper insert part to project into the passage of the lower insert part. This multiple part configuration—the insert assembly might be build up from more than the named two part—allows installation of the insert assembly in steps. This is especially of interest for sub surface use, but might also be applied in case of (above) surface use. If necessary, the upper insert part with the operating mechanism and tubes can be replaced or temporarily removed without removing the lower insert part. In this embodiment, earlier mentioned flapper valves or other type of valve might be arranged inside each passage of the lower part in order to be close the passages of the lower insert part when the upper insert part is (temporarily) removed.

According to a further embodiment of the valve according to the invention, the valve housing is arranged and/or configured for plugging insertion into the production tubing. The term plugging insertion means that the valve housing fits like a plug into the production tubing, i.e. when inserted into the production tubing the valve housing blocks essentially the entire cross section of the production tubing (the passage—when open—of course allowing passage of medium). In case of a sub surface safety valve (SSSV) configuration, the valve housing will be fully inserted into the production tubing. In case of a surface safety valve (SSV) configuration, at least the lower part of the valve housing will be inserted into the upper end of the production tubing. In case of a surface safety valve (SSV) configuration, it might however also be conceivable that the valve housing is fully inserted into the production tubing.

According to a further embodiment of the valve assembly according to the invention, the valve housing is provided with an outer seal, which is attached to the outside of the valve housing, extends circumferentially around the valve housing and seals, when the valve housing is inserted into the production tubing, circumferentially against the inner side of the production tubing to prevent fluid from bypassing the valve housing between the outside of the valve housing and the inside of the production tubing.

According to a second aspect, the object of the invention is achieved by providing a tree for a hydrocarbon well, said well comprising a production tubing extending from a well head in the direction of a lower end of the well and a tree arranged onto the well head; wherein the tree is provided with a valve according to the first aspect of the invention.

According to a further embodiment of the second aspect of the invention, the upper passage port of a first said passage is flow connected to, and preferably horizontally aligned with, a flow wing port of the tree; and wherein the first passage and accompanying valve member define a production flow safety valve.

According to a third aspect, the object of the invention is achieved by providing a retrofit assembly for a tree of a hydrocarbon well, wherein the retrofit assembly comprises:

a spool to be mounted on top of a—already present—tree of a hydrocarbon well with the longitudinal axis of the spool axially aligned with the vertical axis of the tree; and a valve according to the first aspect of the invention, wherein the upper passage opening is flow connected to, and preferably horizontally aligned with, a flow wing port of the tree; and wherein the passage and tubular valve member define a (above) surface safety valve for the production flow, such as an upper master valve or lower master valve;

wherein the spool is internally provided with a circumferential seat surface facing upwardly and wherein the valve housing is externally provided with a mating circumferential support surface facing downwardly.

According to a fourth aspect, the object of the invention is achieved by the sub-surface use of a valve according to the first aspect of the invention in a hydrocarbon well, said well comprising a production tubing, which extends from a well head in the direction of a lower end of the well and which is internally provided with at least one nipple, such as a landing nipple; wherein the valve housing is adapted to be completely inserted into the production tubing and externally provided with locking means, such as locking dogs, adapted for engagement into a said nipple; and wherein the passage and tubular valve member define a production flow safety valve.

According to a fifth aspect, the object of the invention is achieved by providing a hydrocarbon well, comprising one or more selected from the group comprising:

a valve according to the first aspect of the invention;

a tree according to the second aspect of the invention;

a retrofit assembly according to the third aspect of the invention;

a valve used according to the fourth aspect of the invention.

According to a sixth aspect, the object of the invention is achieved by providing a method of retro-fitting a valve, such as a production flow safety valve, of a hydrocarbon well comprising a production tubing, the method comprising the following steps:

removing a valve, such as a production flow safety valve, to be retrofitted from a hydrocarbon well;

placing a valve according to the first aspect of the invention into the well by inserting the valve housing in plugging manner into the production tubing;

arranging the passage and tubular valve member such that, when the tubular valve member is in its flow position, flow communication is provided between the internal of the production tube and the internal of the tubular valve member.

The invention will now be explained, merely by way of example, with reference to the accompanying drawings.

FIG. 3 shows schematically a view of a sub surface safety valve according to the invention.

Figure 1:
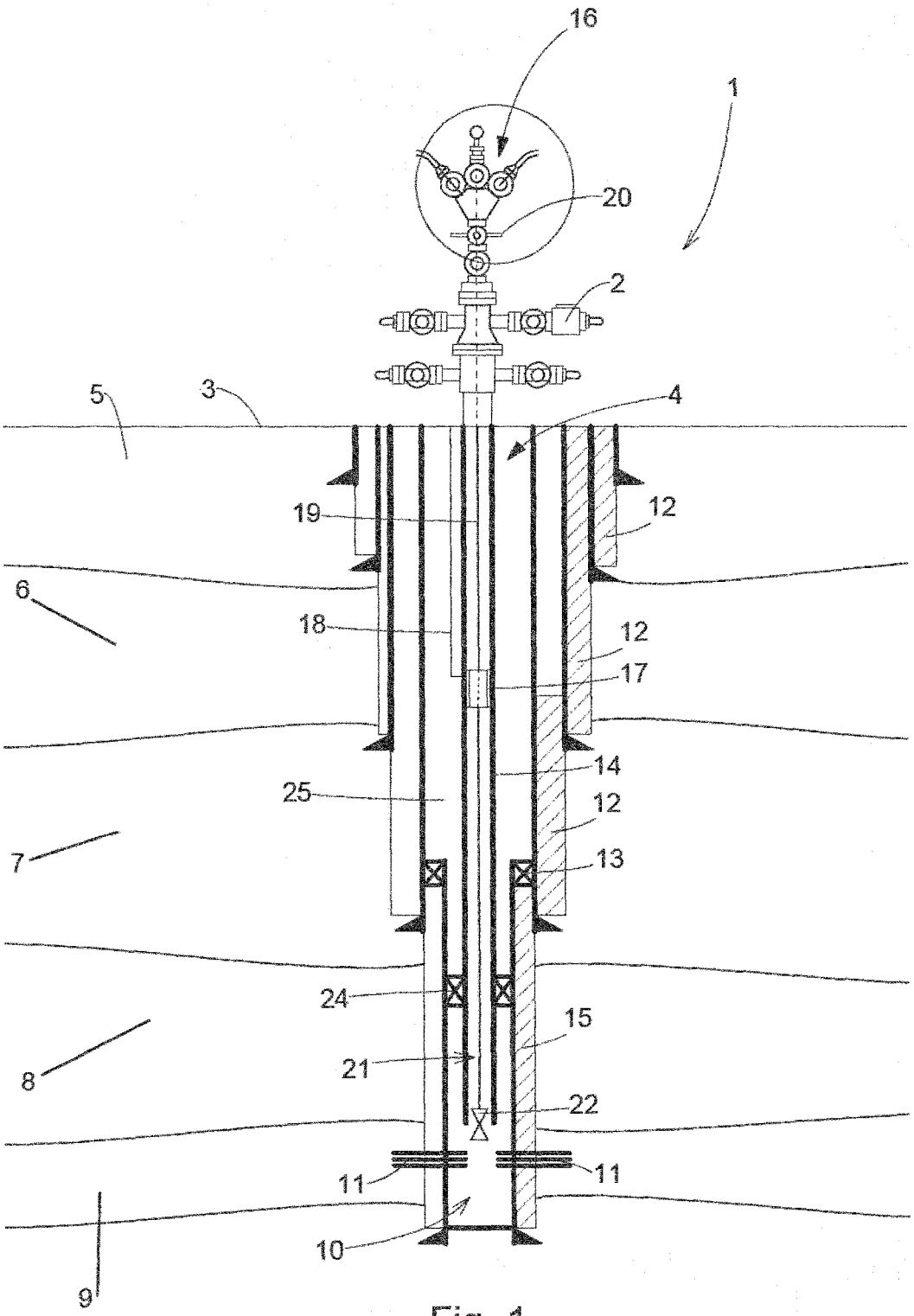
FIG. 1 shows schematically a cross-sectional view of an exemplary hydrocarbon well, in this example a hydrocarbon production well, provided with a system for injecting a treatment fluid into the production zone of the hydrocarbon well in accordance with the present invention.

FIG. 1 shows schematically a hydrocarbon well, in this case a hydrocarbon production well 1, according to the invention. The hydrocarbon well 1 comprises a wellbore or borehole 4 which has been drilled from the surface 3 through a number of earth formations 5, 6, 7, 8 up to a production formation 9. The production formation 9 comprises hydrocarbons, for example oil and/or gas. The wellbore 4 is lined with casings 12 and a liner 15 which is suspended from the lowermost casing 12 by means of a liner hanger 13. The liner 15 extends from the lowermost casing 12 to the production formation 9 and comprises perforations 11 for allowing fluid communication from the production formation 9 to a production zone 10 of the hydrocarbon well 1.

A production tubing 14 is disposed within the casings 12 and the liner 15 of the wellbore 4. The production tubing 14 may be constructed in various ways. For example, the production tubing 14 comprises sections of standard production tubing which are connected together by threads. The production tubing 14 extends from a wellhead 2 of the hydrocarbon well 1 to the production zone 10. Production fluids, such as oil and/or gas, may be conveyed to the wellhead 2 at the surface 3 through the interior of the production tubing 14. A Christmas tree 16 is installed on the wellhead 2 so as to control fluid flow in and out of the wellbore 4.

A sub surface safety valve 17 (also called down hole safety valve 17) according to the invention is installed within the production tubing 14. In this exemplary embodiment, the sub surface safety valve 17 is constructed as a surface-controlled subsurface safety valve. The safety valve 17 is situated at a depth which is greater than 50 m, for example at approximately 100 m. The safety valve 17 provides emergency closure of the production tubing 14 in the event of an emergency. The safety valve 17 is designed to be fail-safe, i.e. the wellbore 4 is isolated in the event of failure or damage to the surface production control equipment. An annular space 25 is defined between the outer radial surface of the production tubing 14 and the casings 12. A hydraulic control line 18 extends from the surface 3 within the annular space 25 to the safety valve 17 so as to control the safety valve.

A packer member 24 is arranged between the production tubing 14 and the liner 15 so as to secure in place a lower portion of the production tubing 14 and to substantially isolate the annular space 25 from the interior of the production tubing 14. For example, the packer member 24 comprises a means for securing the packer member 24 against the wall of the liner 15, such as a slip arrangement, and a means for establishing a reliable hydraulic seal to isolate the annular space 25, typically by means of an expandable elastomeric element. The portion of the production tubing 14 below the packer member 24 is generally referred to as the tail.

The hydrocarbon well 1 according to FIG. 1 comprises an additional tubing 19. This additional tubing might for example be a system for injecting a treatment fluid into the production zone 10. The system for injecting a treatment fluid into the production zone 10 comprises a treatment fluid injection tubing 19 having an upper supply end 20 and a lower discharge end 21. The upper supply end 20 is installed in the Christmas tree 16.

The treatment fluid injection tubing 19 is arranged in the interior of the upper part of the production tubing 14, which upper part extends from the Christmas tree 16 to the safety valve 17. The treatment fluid injection tubing 19 passes the safety valve 17 and runs further downward through the interior of the lower part of the production tubing 14 up to the lower discharge end 21 in the production zone 10. Thus, the treatment fluid injection tubing 19 extends below the safety valve 17 and below the packer member 24. The treatment fluid injection tubing 19 may be several kilometers long.

The treatment fluid injection tubing 19 comprises an upper pipe which runs from the wellhead 2 to the safety valve 17, a passage duct which passes the safety valve 17, and a lower pipe which extends from the safety valve 17 to the production zone 10. The inner diameter of the pipes may be—as is known from prior art—less than 1 cm, preferably less than 0.5 cm. However, the inner diameter of the tubing 19 may be much larger than 1 cm as well, for example 2.5 cm or larger. Further the additional tubing 19 can be stiff or rigid. The lower end of the treatment fluid injection tubing 19 might comprise a treatment fluid injection valve 22.

Within the scope of the present invention an additional tubing 19 might also be absent. The discussed additional tubing 19 is not a requirement for the present invention. An additional tubing 19 might however be applied in conjunction with the present invention. In case present, it is to be noted that, although the additional tubing 19 is above described as a system for injecting a treatment fluid into the production zone 10, this is just an example of an additional tubing which can be useful in a hydrocarbon well. Additional tubings 19 for other purposes are very well conceivable. An additional tubing 19 might also serve as a guide for bringing a measurement device, a tool, an inspection means (like a camera), or any other object to any level between the well head and the production zone. Further, an additional tubing might serve the purpose of taking a sample from any level between the well head and the production zone.

Figure 2:
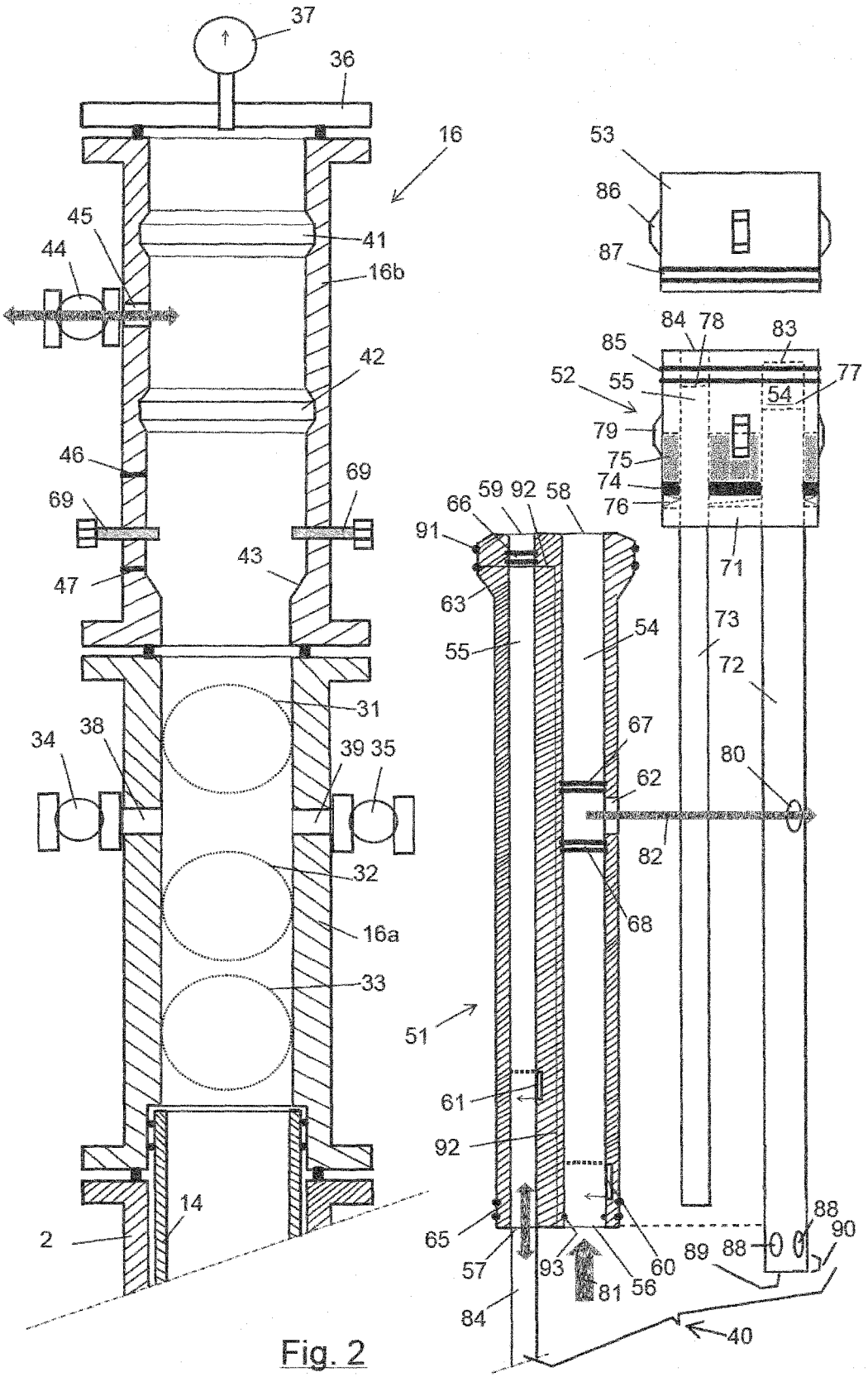
FIG. 2 shows schematically a view of a Christmas tree of a hydrocarbon well, such as a hydrocarbon production well, according to the invention.

FIG. 2 shows schematic view of a (Christmas) tree 16 according to the invention for a hydrocarbon well according to the invention. The tree 16 comprises an original tree **16*a* and an additional spool 16*b* on top of the original tree 16*a*. The additional spool 16*b* is part of a retro fit assembly comprising this spool 16*b* and a valve assembly 40. The valve assembly 40 comprises a valve, in this case a safety valve 51, 54, 72, 88, 90, according to the invention. The spool 16*b* serves the purpose of mounting the valve assembly 40 in the tree 16** by means of a hanging technique which is as such conventional in the field of hydrocarbon wells.

With the term 'original tree' is indicated that it is a tree of an already existing hydrocarbon well, such as a tree of an already existing hydrocarbon production well. Before retrofitting, this original tree **16*a* contained a so called swab valve, a so called upper master valve and a so called lower master valve. Reference no. 31 indicates the location where the swab valve was located, no. 32 the location where the upper master valve was located and no. 33 the location where the lower master valve was located. Further, no. 34 indicates the so called killer wing valve mounted on a killer wing port 38 and no. 35 indicates the so called flow wing valve mounted on the flow wing port 39 for discharging production flow. The lower end of the original tree 16*a* is mounted on the well head 2 and the production tubing 14 hangs with its upper end in the lower end of the original tree or (not shown) in the well head 2**.

The spool **16*b* is mounted on the upper end of the original tree 16*a*. This mounting can be done in conventional manner as is well known to the skilled person, like a manner as is also used for mounting the tree 16*a* onto the well head 2. The upper end of the spool 16*b* is closed by a cap 36 provided with a pressure gauge 37. This cap 36 with pressure gauge 37 was previously mounted on top of the original tree 16*a***.

The spool 16*b* is provided with so called hanger nipples, an upper hanger nipple 41 and a lower hanger nipple 42. These hanger nipples are essentially circumferential recesses formed in the inner wall of the spool 16*b*. At its lower side, the spool 16*b* is internally provided with a seat surface 43 facing upwardly and extending in circumferential direction al around.

Further, the spool 16*b* is provided with a side port 45 and valve 44 to allow a fluid flow to exit or enter the spool 16*b*. A hydraulic port 46 is provided for hydraulic fluid to enter and/or leave the spool 16*b* in order to allow control of a hydraulic operated device inside the spool. No. 47 indicates an optional additional hydraulic port.

The valve assembly 40 as shown in FIG. 2 comprises an insert assembly made of three parts: a lower insert part 51, an upper insert part 52 and a so called bull plug 53. For clarity of the drawing, these parts 51, 52 and 53 are shown, in disassembled state, on the same vertical level with respect to the spool 16*b* and tree 16*a* as they will have in mounted condition. With respect to 'the same vertical level' it is noted that the locking dogs 79 are—due to a small error in the drawing—shown at a slightly lower vertical level than the landing nipple 42 in which theses dogs will engage. The locking dogs 79 and landing nipple 42 should lie on the same horizontal line.

The lower insert part 51 is, in this example, formed by a massive body of steel having two longitudinal passages, a first passage 54 having a large diameter and a second passage 55 having a smaller diameter. Both passages 54 and 55 have an open lower end 56, 57 and open upper end 58, 59. A spring biased flapper valve 60, 61 is provided in both passages. These flapper valves 60, 61 are shown in (vertical) open position. In closed position these flapper valves 60, 61 will extend horizontally to shut off the passages 54 and 55 completely in order to prevent flow from passing through the passages 54 and 55. A radial bore 62 provides a side port in the first passage 54.

The lower insert part 51 is optionally provided with a hydraulic line 92. When mounted into the spool 16*a*, 16*b*, this hydraulic line 92 will be connected with hydraulic port 47. Hydraulic line 92 can be used for operation of a wide range of devices. It can for example be used for operation of the flapper valve 60 and or flapper valve 61. It can however also be used for operation of a device arranged below the first insert part 51 inside the tubing 14. It is for example conceivable that a device operated by means of hydraulic line 92 is arranged at the bottom of the well.

In order to provide sealing, the lower insert part 51 is provided with: one or more outer seals 65 extending all around the circumference of the lower end of the lower insert part; one or more outer seals 91 extending around the circumference of the upper end of the lower insert part; one or more inner seals 66 provided in the second passage; one or more inner seals 67 provided in the first passage above the bore 62; one or more inner seals 68 provided in the first passage below the bore; and one or more inner seals 93 provided in the first passage at the lower end of the first passage.

To mount the lower insert part 51 in the tree 16, the cap 36 is—when present—removed and the lower insert is simply lowered into the spool 16*b* until the downwardly facing support surface 63 comes to rest on the mating seat surface 43. Tie down bolts 69 may be used to fix the lower insert part 51 in the spool 16*b*. When the support surface 63 rests on the mating seat surface 43, the lower end of the lower insert part 51 projects into the upper end of the production tubing. The lower end of the lower insert part 51 fits like a plug in the upper end of the production tubing 14. The outer seal 65 seals circumferentially against the inner side of the production tubing 14 to prevent fluid from bypassing between the outside of the insert assembly and the inside of the production tubing. A further tubing 84 might be mounted—in sealing manner—to the lower port 57 of the second passage 55.

The upper insert part 52 comprises a body part 71 supporting a first tube 72 and a second tube 73. In order to accommodate the first and second tube in slidable manner in the upper insert part, the upper insert part is provided with passages corresponding to the passages in the lower insert part. The diameter of the first tube 72 is less than, preferably about, the diameter of the first passage 54 so that the first tube can shift vertically with respect to the first passage. Correspondingly, the diameter of the second tube 73 is less than, preferably about, the diameter of the second passage 55 so that the second tube can shift vertically with respect to the second passage 55. Both tubes 72 and 73 are carried by and fixed to a common piston member 74. The first tube 72 has an upper end 77 and the second tube 73 has an upper end 78. The lower end of the second tube 73 is open, whilst the lower end 89 of the first tube 72 is closed. The piston member 74 is immovable with respect to the tubes 72 and 73. A spring 76 pre-biases the piston member 74 in upward direction, the blocking direction. In order to be able to push the tubes 72 and 73 downward against the action of the spring 76, a hydraulic pressure chamber 75 is provided at the upper side of the piston member 74. This hydraulic pressure chamber can be filled with and relieved from hydraulic medium via hydraulic port 46.

To mount the upper insert part 52 in the tree 16, the cap 36 is—when present—removed and the upper insert is simply lowered into the spool 16*b* until the locking dogs 79 are radially aligned with the lower hanger nipple 42. The locking dogs 79 may be spring biased so that they automatically engage in the lower hanger nipple. In order to prevent disengaging of the locking dogs 79 from the lower hanger nipple, the locking dogs may be fixated to prevent them from withdrawing in radial inward direction. This principle of locking by means of locking dogs and an hanger nipple is a technique well known to a person skilled in the field of hydrocarbon wells. When the locking dogs engage in the lower hanger nipple, the first tube 72 projects into the first passage 54 and the second tube 73 projects into the second passage 55. The inner seal 66 seals circumferentially against the outer side of the second tube 73 and the inner seals 67 and 68 seal circumferentially against the first tube 72 to prevent fluid from bypassing between the inner side of the respective passage and the outer side of the respective tube. During mounting of the upper insert part 52 into the tree 16, the second tube 73 will push the flapper valve 61—which is initially in closed horizontal position—into its vertical open position. The flapper valve 60 will be opened by the first tube 72. These flapper valves thus serve as maintenance closures closing the passages in case the insert part 52 might be removed for maintenance, repair or other reasons.

In case the flapper valve 60 would be arranged lower and/or in case the first tube 72 would be shorter, the flapper valve 60 would not be opened when mounting the upper insert part 52 in the tree. Similarly, opening of the flapper valve 61 would not occur during mounting of the upper insert part in the tree, in case the flapper valve 61 would have been arranged lower and/or in case the second tube 73 would be longer. In this case one or more of the flapper valves not only serve as maintenance closure, but also serve as controllable closure during operation. In case the tube is a tubular valve member of the safety valve according to the invention, as is the case with the first tube 72, the flapper valve 60 then servers as an additional valve/controllable closure.

In mounted condition, an outer seal 85 prevents bypass between the spool wall and the outside of the upper insert part 52.

FIG. 2 shows the tubes 72 and 73 in a condition in which they are fully pushed downwards in the so called flow position. In this position, the lower end of the first tube 72 projects downwardly from the first insert part 51 and extends freely in the production tubing 14 arranged below the first insert part 51. When the first tube 72 is in the so called flow position, the radial aperture 80 in the first tube 72 is radially aligned with the bore 62 and the side port 39.

The first tube 72 has a closed lower end 89 and one or more radial inlet apertures 88. These one or more inlet apertures 88 provide a flow connection between the internal of the tube 72 and the surrounding of the tube 72 so that fluid can enter the tube (or reversely can leave the tube). When the first tube is in the flow position, at least part of the one or more radial apertures 88 lie outside the first insert part 51 and thus outside the first passage 54.

The part of the first tube 72, which extends from the closed lower end 89 of the first tube 72 to the one or more radial inlet apertures 88, is defined as the lower end part 90 of the first tube 72 and is closed so that at this section of the first tube 72 no fluid will enter the tube 72 or leave the tube 72.

When the tubes are in the so called flow position, production fluid can, as indicated with arrows 81 and 82, flow from the production tubing 14, through the one or more radial apertures 88, into the lower end of the first tube 72, through the first tube 72, through the radial aperture 80, through the bore 62 into the side port 39 of the original tree 16*a*. The first passage 54 in the upper insert part 52 has a closed upper end, whilst the first tube 72 is preferably open at its upper end. Alternatively, the upper end 77 of the first tube 72 might be closed, in which case the upper end 83 of the first passage 54 in the upper insert part 52 has preferably a venting opening.

In absence of pressure in chamber 75 or upon relieving the pressure in the pressure chamber 75, the piston member 74 and tubes 72, 73 will be pushed upwards by the spring 76 to the blocking position. In this blocking position, the one or more radial inlet apertures 88 are retracted to lie inside the first insert part 52 and thus inside the first passage 54. Consequently no flow is possible from the production tubing 14 into the first tube 72 or first passage 54 as the closed lower end part 90 of the first tube 72 blocks any flow from below the first insert part 51 in upward direction to for example the radial bore 62. It is noted that—In FIG. 2 it can be seen that the distance between upper end 77 of tube 72 and the closed upper end 83 of passage 54 is smaller than the axial distance between lower end 56 of passage 54 and lower end 89 of tube 72. From this exemplifying embodiment it thus follows, that, the blocking position, the closed lower end part 90 of the first tube 72 might lie fully or partially outside the first passage 54. In other words, this lower end part 90, might, in the blocking position, project downwards from the first insert part 51.

In this blocking position, the radial aperture 80 will lie opposite a closed inner wall of the first passage 54 providing a second blockage so that no flow is possible between the inside of the first tube 72 and the flow wing port 39. This second blockage is as such optional.

In the above valve assembly 40, a valve, such as a safety valve, according to the invention is present. In as far as the wording of terms as used in the claims differs from the wording of terms as used in relation to the description of valve assembly 40 above, the wording of terms used for valve assembly 40 relate to the wording of terms used in the claims as follows: the insert part 51, optionally together with the insert part 52, represents the valve housing; the first tube 72 represents the tubular valve member; the piston member 74, spring 76 and pressure chamber are a representation of the operating mechanism; the first passage 54 represents the term 'passage' in the claims; the open lower end 56 of the first passage 54 represents the lower passage opening; the radial bore 62 represents the upper passage opening.

In relation to the valve according to the invention, the valve assembly 40 might optionally be provided with the already discussed passage 55 and second tube 73. In case these second passage 55 and second tube 73 might be absent, for example because their usefulness might not be contemplated with respect to a specific well, the diameter of the first passage 54 and first tube 72 might be made much larger.

In case the second passage 55 and second tube 73 are present, a secondary fluid flow through the second passage 55 and second tube 73 is possible both in the blocking position and in the flow position of the tubes 72, 73. This is due to the fact that in this configuration the flapper valve 61 is always open, that the second tube is open at both ends, and that the second passage is open at both ends 57 and 84. This secondary flow can leave or enter the tree via the side port 45 and may be controlled by a control valve 44. Taking into account that the second tube 73 and second passage 55 always allow flow, it is also possible to use these for introducing—for example by means of a wire—an instrument, tool, sensor or other device into the well. In order to provide additional protection against leakage of any fluid through the upper end of the spool 16*b*, a bull plug 53 may be provided. This bull plug 53 has locking dogs 86 for locking engagement in upper landing nipple 41 and an outer seal 87.

Figure 3B:
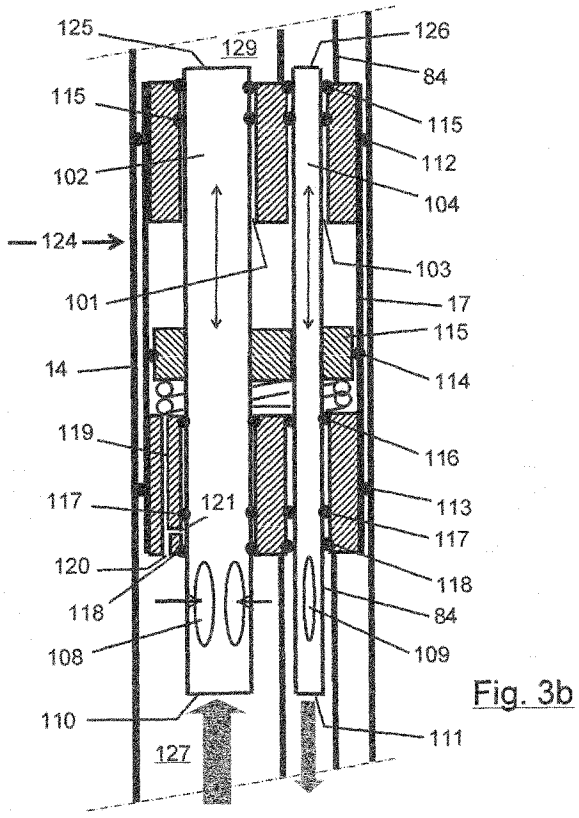
FIG. 3*a* shows the safety valve in blocked position and FIG. 3*b* shows the safety valve in flow position.
Figure 3A:
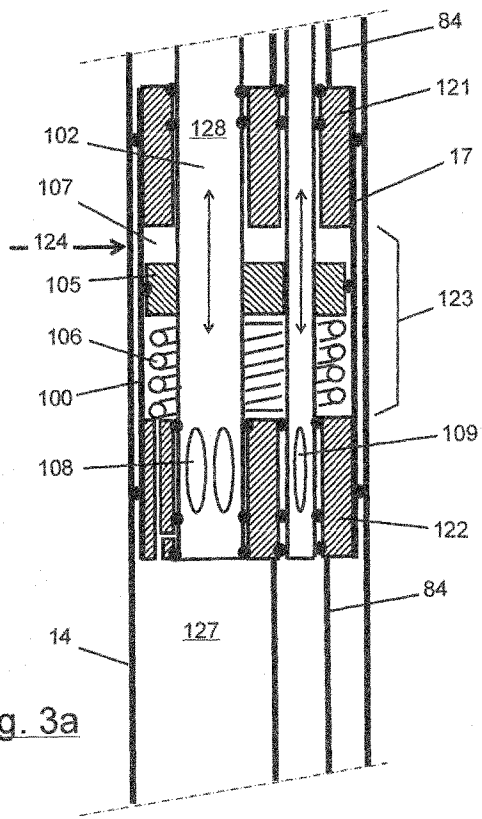

FIG. 3 shows schematically the safety valve assembly 17 of FIG. 1 in more detail. FIG. 3*a* shows the assembly in blocking position (the valves being closed) and FIG. 3*b* shows the assembly in flow position (the valves being opened). Both valves are according to the invention. One of the valves (first tube 102 in first passage 101) is actually used as safety valve in the production flow, the other valve (second tube 104 in second passage 103) is, in this exemplifying embodiment, used as a valve, for example also for safety reasons, in a secondary flow.

The safety valve assembly 17 of FIG. 3 is used as a sub surface safety valve assembly. The safety valve assembly 17 is configured as one unit so that—contrary to the example of FIG. 2—it can be installed as one unit into the production tubing 14. This installing might be done with a wire line technique which is known to a person skilled in the field of hydrocarbon wells. Fixation of the safety valve assembly 17 inside the production tubing might be done also with know techniques (not shown), like—as is described as an example in relation to FIG. 2—a landing nipple formed in the internal of the production tubing and locking dogs provided on the outside of the safety valve assembly. Referring to FIG. 3, the safety valve assembly 17 comprises an insert assembly arranged in a cylindrical housing 100 (representing the valve housing of the claims) which is except for passages to be described closed at its upper side 121 and lower side 122. The cylindrical housing 100 is provided with two passages, a first passage 101 and a second passage 103. Both passages extend from the lower end face of the housing 100 up to the upper end face of the housing 100. A tube (representing the tubular arranged in each passage. First tube 102 is arranged in the first passage 101 and second tube 104 in second passage 103.

A control compartment 123 (representing the operating mechanism of the claims) is provided inside the housing 100. This control compartment comprises a spring 106, a piston member 105 and a hydraulic pressure chamber 107. The first and second tube 102 and 104 are both fixed to and immovable with respect to the piston member 105. The spring 106 pre-biases the piston member 105 in upward direction. The hydraulic pressure chamber 107 exerts a downward force onto the piston member 105 when it is filled with a hydraulic fluid—indicated by arrow 124—under a pressure sufficient to overcome the force of the pre-biased spring 106. In order to prevent leakage of hydraulic medium from the pressure chamber to the spring 106, a seal 114 is mounted to the piston member 105 for sealing engagement with the inner wall of the control compartment 123.

The tubes 102 and 104 are each provided with one or more radial inlet apertures 108 and 109, respectively. The lower ends 110 and 111 of both tubes are closed. The upper ends 125 and 126 of both tubes (see FIG. 3*b*) are both open. With respect to both tubes a closed lower end part 140 respectively 141 is defined as the part of the respective tube 102, 104 extending from the respective lower end 110, 111 of the respective tube 102, 104 to the respective one or more radial inlet apertures 108, 109 of the respective tube 102, 104.

A pressure equalizing line 119 is provided in the lower part of the housing. This pressure equalizing line 119 debouches with its lower end into the internal 127 of the production tubing. In order to prevent a build up of pressure in the compartment containing the spring upon compression of the spring 106, this pressure equalizing line might debouch in the compartment containing the spring 106. Due to the lower end 110 of the first tube being closed, the first tube might experience large upward forces in case the pressure in the internal 127 of the production tubing is high. Consequently large hydraulic pressure in the pressure chamber 107 might be required to push the tubes downward. The hydraulic power required to push the piston member 105 and tubes 102, 104 downward might be reduced by providing the pressure equalizing line 119 with an equalizing port 121 debouching into the passage 101 at a location which lies below the radial passage 108 when the first tube is in its blocking position. Above and below the equalizing port 121, a circumferential seal 117 and circumferential seal 118 are provided to define a pressure equalizing space around the first tube 102. When the first tube 102 is pushed downwards, the equalizing line 119 provides fluid communication between the internal 127 of the production tubing and the internal of the first tube 102 as soon as the radial aperture 108 passes the upper seal 117. As a result, the upward pressure acting on the closed lower end 110 of the first tube is compensated for. As will be clear also the embodiment of FIG. 2 might be provided with corresponding equalizing system 119, 120, 121 with corresponding seals 117, 118.

Outer seals 112 and 113 are provided on the outside of the housing 100. These seals extend all around the housing 100 and seal against the inner wall of the production tubing 14 in order to prevent bypass of hydrocarbon fluid (gas and/or liquid) around the insert valve assembly 17. In order to prevent similar bypass around the tubes 102 and 104 through the passages 101 and 103, respectively, several inner seals 115, 116, 117 and 118 are provided.

The first passage 101 communicates at both ends with the inner space 127, 129 of the production tubing 14. The second passage 103 is at both ends sealingly connected to a further tubing 84, which extends through the production tubing. The diameter of the second tube 104 will consequently be smaller than the diameter of the additional tubing 84. It is noted that depending on circumstances, the second tube 104 can also be absent or might have an open bottom end. Absence of the second tube 104 or an open bottom end of tube 104, allows the additional tubing to be used easier as guide channel for an instrument, sensor, tool or other device to be brought deep into the well. Note however, that, although less easy due to the radial passage 109, this guide function can also be provided in presence of the second tube 104 having closed lower end 111 and one or more radial inlet/outlet passages 109.

The safety valve assembly 17 functions as follows. FIG. 3*a* shows the blocked position, in which there is nu flow communication between the upper end and the lower end of the insert assembly. In this blocked condition, the spring exerts a pre-tension force directed in upward direction in order to keep the piston member and tubes in blocked position. Starting from this blocked position, hydraulic fluid is supplied (arrow 124) to the hydraulic pressure chamber 107. This causes the piston member 105 and tubes 102 and 104 to move downward to the flow position as shown in FIG. 3*b*. In this flow position, hydrocarbon fluid (gas and/or liquid) is allowed to flow through radial apertures 108 into the first tube 102, flows upward through the first tube 102 and leaves the first tube 102 to enter the production tubing 14 again at a location above the insert assembly 100. Similarly, a treatment fluid or other fluid can be passed through the insert assembly when the piston member 105 and tubes 102 and 104 are in flow position. Treatment fluid supplied from—for example—the surface arrives through additional tubing 84 at the upper end of the insert assembly 100. This fluid enters the second tube 104 through its open upper end 126, passes through the second tube 104 downwards and leaves the second tube 104 through the radial aperture(s) 109—which are, within the scope of this invention, in this situation in normal use outlet apertures, but might in case of emergency act as inlet apertures for a fluid willing to blow out—to continue downwards through the part of the additional tubing 84 extending below the insert assembly 100. In order to keep the insert assembly 100 in its flow position, the high pressure in the pressure chamber 107 is to be maintained. In case the safety valve assembly 17 is to be closed, for emergency reasons or other reasons, the hydraulic pressure in the pressure chamber is released (lowered) and the spring 106 will push the piston member 105 and tubes 102, 104 to the blocked position of FIG. 3*a*. This functions as a fail safe mechanism.

As will be clear, a hydrocarbon well can according to the invention very well be equipped with a surface configuration of the valve according to the invention (for example as illustrated in FIG. 2) as well as a sub-surface configuration of the valve according to the invention (for example as illustrated in FIG. 3). Further it will be clear that the configuration of the (above surface) valve as shown and elucidated with reference to FIG. 2 can also be applied as sub surface valve instead of the safety valve assembly 17 as shown in FIG. 3. Similarly, it will be clear that the configuration of the (sub surface) valve assembly 17 as shown and elucidated with reference to FIG. 3 can also be applied as (above) surface valve assembly instead of the valve assembly as shown in FIG. 2.

The description above describes exemplary embodiments of the present invention for the purpose of illustration and explanation. It will be apparent, however, to the skilled person that many modifications and changes to the exemplary embodiments set forth above are possible without departing from the scope of the invention. It is noted that the features described above may be combined, each individually or in any combination of features, with one or more of the features of the claims.

The invention claimed is:

1. A christmas tree for a hydrocarbon wellbore, said wellbore comprising a production tubing extending from a well head in the direction of a downhole end of the wellbore and a tree arranged onto the well head; wherein the tree is provided with a valve;

wherein said valve comprises:

a valve housing;

a tubular valve member having an axially extending tube wall;

an operating mechanism for operating the tubular valve member;

wherein the valve housing has a lower end and is provided with a passage extending from a lower passage opening to an upper passage opening, the lower passage opening being provided in the lower end of the housing and opening in downward direction;

wherein the valve housing comprises a radial bore providing a side port in the passage;

wherein the radial bore has one end debouching into the passage and the other end facing away from the passage for connection to a further flow channel;

wherein the tube wall is provided with one or more radial inlet apertures through said tube wall;

wherein the tube wall is provided with a radial outlet aperture through said tube wall between the one or more radial inlet apertures and an upper end of the tubular valve member;

wherein a lower end part of the tubular valve member is defined as a part of the tubular valve member extending from the lower end of the tubular valve member to the one or more radial inlet apertures;

wherein said lower end part is closed;

wherein the tubular valve member extends in the passage and is axially movable, by the operating mechanism, with respect to the valve housing between a flow position and a blocking position;

wherein, in the blocking position, the tubular valve member is retracted in the valve housing such that the one or more radial inlet apertures lie inside the valve housing and fluid flow between the lower passage opening and upper passage opening is prevented by the closed lower end part of the tubular valve member; and wherein, in the flow position, the tubular valve member projects from the lower end of the valve housing in an extent such that the one or more radial inlet apertures lie outside the valve housing to allow fluid flow from outside the tubular valve member via the one or more radial inlet apertures through the tubular valve member, the radial outlet aperture and the radial bore, to the further flow channel; and wherein the upper passage opening of said passage is flow connected to a flow wing port of the tree; and wherein the passage and accompanying valve member define a production flow safety valve.

2. The christmas tree of claim 1, wherein the upper passage opening of said passage is horizontally aligned with the flow wing port.

3. The christmas tree of claim 1, wherein the passage is provided with at least one inner seal, which is attached to the inside of the passage, extends circumferentially around the tubular valve member and seals circumferentially against the tubular valve member to prevent fluid from bypassing the tubular valve member between the outside of the tubular valve member and the inside of the passage.

4. The christmas tree of claim 3, wherein, viewed in the blocking position of the tubular valve member, a first said inner seal lies above the one or more radial inlet apertures whilst a second said inner seal lies below the one or more radial inlet apertures.

5. The christmas tree of claim 1, wherein the valve housing is provided with a pressure equalizing line debouching on the one hand into the space below the valve housing and on the other hand into the passage at a location, which lies, when the tubular valve member is in its blocking position, below the one or more radial inlet apertures.

6. The christmas tree of claim 1, wherein said radial outlet aperture and the radial bore are radially aligned when the tubular valve member is in its flow position; and optionally wherein the radial outlet aperture is, when the valve member is in its blocking position, closed by the inner wall of the passage; and/or wherein a third said inner seal is provided above the radial bore and a fourth said inner seal is provided below the radial bore; and/or wherein the tubular valve member or passage is closed in an area above the radial outlet aperture and the radial bore.

7. The christmas tree of claim 1, wherein movement of the tubular valve member to the flow position defines an opening direction, and movement of the valve member to the blocking position defines a closing direction;

wherein the operating mechanism comprises:

a spring biasing the tubular valve member in the closing direction;

a piston member fixed to the tubular valve member;

a pressure chamber adjacent the side of the piston member facing in the closing direction;

wherein the pressure chamber is provided with an inlet/outlet valve assembly for feeding a hydraulic fluid into the pressure chamber to move the valve member in the opening direction respectively to discharge said hydraulic fluid from the pressure chamber for moving the valve member in the closing direction by action of the spring; and/or wherein a flapper valve is provided in a section of the passage, which flapper valve is spring biased into a closed position blocking the passage; and wherein this passage, tubular valve member and flapper valve are arranged for opening the flapper valve upon passing the tubular valve member through the section of this passage and closing the flapper valve upon withdrawing the tubular valve member from the section of this passage.

8. The christmas tree of claim 1, wherein the valve housing is provided with a circumferential hanger rib for support onto a hanger seat extending around the valve housing.

9. The christmas tree of claim 8, wherein the hanger rib comprises: a continuous rib extending continuously all around the valve housing; or a multiplicity of rib segments arranged at intervals circumferentially around the valve housing.

10. The christmas tree of claim 1, wherein the valve housing comprises a lower insert part and an upper insert part;

wherein the lower insert part comprises the passage and is adapted for plugging insertion into the production tubing; and wherein the operating mechanism is provided in the upper insert part and the tubular valve member is suspended from the upper insert part to project into the passage of the lower insert part.

11. The christmas tree of claim 1, wherein the valve is a production flow safety valve.

12. A retrofit assembly for a tree of a hydrocarbon well, wherein the retrofit assembly comprises:

a spool to be mounted on top of a tree of a hydrocarbon well with the longitudinal axis of the spool axially aligned with the vertical axis of the tree; and a valve comprising:

a valve housing;

a tubular valve member having an axially extending tube wall;

an operating mechanism for operating the tubular valve member;

wherein the valve housing has a lower end and is provided with a passage extending from a lower passage opening to an upper passage opening, the lower passage opening being provided in the lower end of the housing and opening in downward direction;

wherein the valve housing comprises a radial bore providing a side port in the passage;

wherein the radial bore has one end debouching into the passage and the other end facing away from the passage for connection to a further flow channel;

wherein the tube wall is provided with one or more radial inlet apertures through said tube wall;

wherein the tube wall is provided with a radial outlet aperture through said tube wall between the one or more radial inlet apertures and an upper end of the tubular valve member;

wherein a lower end part of the tubular valve member is defined as a part of the tubular valve member extending from the lower end of the tubular valve member to the one or more radial inlet apertures;

wherein said lower end part is closed;

wherein the tubular valve member extends in the passage and is axially movable, by the operating mechanism, with respect to the valve housing between a flow position and a blocking position;

wherein, in the blocking position, the tubular valve member is retracted in the valve housing such that the one or more radial inlet apertures lie inside the valve housing and fluid flow between the lower passage opening and upper passage opening is prevented by the closed lower end part of the tubular valve member; and wherein, in the flow position, the tubular valve member projects from the lower end of the valve housing in an extent such that the one or more radial inlet apertures lie outside the valve housing to allow fluid flow from outside the tubular valve member via the one or more radial inlet apertures through the tubular valve member, the radial outlet aperture and the radial bore, to the further flow channel;

wherein the upper passage opening is flow connected to a flow wing port of the tree; and wherein the passage and tubular valve member define a surface safety valve for the production flow;

wherein the spool is internally provided with a circumferential seat surface facing upwardly and wherein the valve housing is externally provided with a mating circumferential support surface facing downwardly.

13. The retrofit assembly of claim 12, wherein the upper passage opening is horizontally aligned with the flow wing port.

14. The retrofit assembly of claim 12, wherein the passage is provided with at least one inner seal, which is attached to the inside of the passage, extends circumferentially around the tubular valve member and seals circumferentially against the tubular valve member to prevent fluid from bypassing the tubular valve member between the outside of the tubular valve member and the inside of the passage.

15. The retrofit assembly of claim 14, wherein, viewed in the blocking position of the tubular valve member, a first said inner seal lies above the one or more radial inlet apertures whilst a second said inner seal lies below the one or more radial inlet apertures.

16. The retrofit assembly of claim 12, wherein the valve housing is provided with a pressure equalizing line debouching on the one hand into the space below the valve housing and on the other hand into the passage at a location, which lies, when the tubular valve member is in its blocking position, below the one or more radial inlet apertures.

17. The retrofit assembly of claim 12, wherein said radial outlet aperture and the radial bore are radially aligned when the tubular valve member is in its flow position; and optionally wherein the radial outlet aperture is, when the valve member is in its blocking position, closed by the inner wall of the passage; and/or wherein a third said inner seal is provided above the radial bore and a fourth said inner seal is provided below the radial bore; and/or wherein the tubular valve member or passage is closed in an area above the radial outlet aperture and the radial bore.

18. The retrofit assembly of claim 12, wherein movement of the tubular valve member to the flow position defines an opening direction, and movement of the valve member to the blocking position defines a closing direction;

wherein the operating mechanism comprises:

a spring biasing the tubular valve member in the closing direction;

a piston member fixed to the tubular valve member;

a pressure chamber adjacent the side of the piston member facing in the closing direction;

wherein the pressure chamber is provided with an inlet/outlet valve assembly for feeding a hydraulic fluid into the pressure chamber to move the valve member in the opening direction respectively to discharge said hydraulic fluid from the pressure chamber for moving the valve member in the closing direction by action of the spring; and/or wherein a flapper valve is provided in a section of the passage, which flapper valve is spring biased into a closed position blocking the passage; and wherein this passage, tubular valve member and flapper valve are arranged for opening the flapper valve upon passing the tubular valve member through the section of this passage and closing the flapper valve upon withdrawing the tubular valve member from the section of this passage.

19. The retrofit assembly of claim 12, wherein the valve housing is provided with a circumferential hanger rib for support onto a hanger seat extending around the valve housing.

20. The retrofit assembly of claim 19, wherein the hanger rib comprises: a continuous rib extending continuously all around the valve housing; or a multiplicity of rib segments arranged at intervals circumferentially around the valve housing.

21. The retrofit assembly of claim 12, wherein the valve housing comprises a lower insert part and an upper insert part;

wherein the lower insert part comprises the passage and is adapted for plugging insertion into the production tubing; and wherein the operating mechanism is provided in the upper insert part and the tubular valve member is suspended from the upper insert part to project into the passage of the lower insert part.

22. The retrofit assembly of claim 12, wherein the valve is a production flow safety valve.

23. Method of retro-fitting an installed valve of a hydrocarbon well comprising a production tubing, the method comprising the following steps:

removing an installed valve to be retrofitted from a hydrocarbon well;

placing a retrofit valve comprising a valve housing into the well by inserting the valve housing in plugging manner into the production tubing, which retrofit valve further comprises:

a tubular valve member having an axially extending tube wall;

an operating mechanism for operating the tubular valve member;

wherein the valve housing has a lower end and is provided with a passage extending from a lower passage opening to an upper passage opening, the lower passage opening being provided in the lower end of the housing and opening in downward direction;

wherein the valve housing comprises a radial bore providing a side port in the passage;

wherein the radial bore has one end debouching into the passage and the other end facing away from the passage for connection to a further flow channel;

wherein the tube wall is provided with one or more radial inlet apertures through said tube wall;

wherein the tube wall is provided with a radial outlet aperture through said tube wall between the one or more radial inlet apertures and an upper end of the tubular valve member;

wherein a lower end part of the tubular valve member is defined as a part of the tubular valve member extending from the lower end of the tubular valve member to the one or more radial inlet apertures;

wherein said lower end part is closed;

wherein the tubular valve member extends in the passage and is axially movable, by the operating mechanism, with respect to the valve housing between a flow position and a blocking position;

wherein, in the blocking position, the tubular valve member is retracted in the valve housing such that the one or more radial inlet apertures lie inside the valve housing and fluid flow between the lower passage opening and upper passage opening is prevented by the closed lower end part of the tubular valve member; and wherein, in the flow position, the tubular valve member projects from the lower end of the valve housing in an extent such that the one or more radial inlet apertures lie outside the valve housing to allow fluid flow from outside the tubular valve member via the one or more radial inlet apertures through the tubular valve member, the radial outlet aperture and the radial bore, to the further flow channel; and arranging the passage and tubular valve member such that, when the tubular valve member is in its flow position, flow communication is provided between the internal of the production tube and the internal of the tubular valve member.

24. The method of claim 23, wherein the installed valve is a production flow safety valve.

25. The method of claim 23, wherein the passage is provided with at least one inner seal, which is attached to the inside of the passage, extends circumferentially around the tubular valve member and seals circumferentially against the tubular valve member to prevent fluid from bypassing the tubular valve member between the outside of the tubular valve member and the inside of the passage.

26. The method of claim 25, wherein, viewed in the blocking position of the tubular valve member, a first said inner seal lies above the one or more radial inlet apertures whilst a second said inner seal lies below the one or more radial inlet apertures.

27. The method of claim 23, wherein the valve housing is provided with a pressure equalizing line debouching on the one hand into the space below the valve housing and on the other hand into the passage at a location, which lies, when the tubular valve member is in its blocking position, below the one or more radial inlet apertures.

28. The method of claim 23, wherein said radial outlet aperture and the radial bore are radially aligned when the tubular valve member is in its flow position; and optionally wherein the radial outlet aperture is, when the valve member is in its blocking position, closed by the inner wall of the passage; and/or wherein a third said inner seal is provided above the radial bore and a fourth said inner seal is provided below the radial bore; and/or wherein the tubular valve member or passage is closed in an area above the radial outlet aperture and the radial bore.

29. The method of claim 23, wherein movement of the tubular valve member to the flow position defines an opening direction, and movement of the valve member to the blocking position defines a closing direction;

wherein the operating mechanism comprises:

a spring biasing the tubular valve member in the closing direction;

a piston member fixed to the tubular valve member;

a pressure chamber adjacent the side of the piston member facing in the closing direction;

wherein the pressure chamber is provided with an inlet/outlet valve assembly for feeding a hydraulic fluid into the pressure chamber to move the valve member in the opening direction respectively to discharge said hydraulic fluid from the pressure chamber for moving the valve member in the closing direction by action of the spring; and/or wherein a flapper valve is provided in a section of the passage, which flapper valve is spring biased into a closed position blocking the passage; and wherein this passage, tubular valve member and flapper valve are arranged for opening the flapper valve upon passing the tubular valve member through the section of this passage and closing the flapper valve upon withdrawing the tubular valve member from the section of this passage.

30. The method of claim 23, wherein the valve housing is provided with a circumferential hanger rib for support onto a hanger seat extending around the valve housing.

31. The method of claim 30, wherein the hanger rib comprises: a continuous rib extending continuously all around the valve housing; or a multiplicity of rib segments arranged at intervals circumferentially around the valve housing.

32. The method of claim 23, wherein the valve housing comprises a lower insert part and an upper insert part;

wherein the lower insert part comprises the passage and is adapted for plugging insertion into the production tubing; and wherein the operating mechanism is provided in the upper insert part and the tubular valve member is suspended from the upper insert part to project into the passage of the lower insert part.

33. The method of claim 23, wherein the retrofit valve is a production flow safety valve or a surface safety valve.

* * * * *